US008476830B2

(12) United States Patent
Hwu et al.

(10) Patent No.: US 8,476,830 B2
(45) Date of Patent: Jul. 2, 2013

(54) COUPLED CAVITY TRAVELING WAVE TUBE

(76) Inventors: Ruey-Jen Hwu, Salt Lake City, UT (US); Laurence P. Sadwick, Salt Lake City, UT (US); Jishi Ren, Ottawa (CA)

( * ) Notice: Subject to any disclaimer, the term of this patent is extended or adjusted under 35 U.S.C. 154(b) by 276 days.

(21) Appl. No.: 12/956,396

(22) Filed: Nov. 30, 2010

(65) Prior Publication Data

US 2012/0133280 A1 May 31, 2012

(51) Int. Cl.
*H01J 19/80* (2006.01)

(52) U.S. Cl.
USPC ..... 315/39; 315/3.5; 315/5; 315/39.3; 315/39.53

(58) Field of Classification Search
USPC ..... 315/3.5, 5, 4, 5.46, 5.36, 5.53, 39.51, 315/39, 39.3, 39.55
See application file for complete search history.

(56) References Cited

U.S. PATENT DOCUMENTS

| | | | | |
|---|---|---|---|---|
| 2,768,322 | A | 10/1956 | Fletcher | |
| 2,889,486 | A | 6/1959 | Guenard | |
| 3,443,146 | A | 5/1969 | Buck | |
| 3,646,389 | A | 2/1972 | Hentschel | |
| 4,409,519 | A | 10/1983 | Karp | |
| 4,422,012 | A | 12/1983 | Kosmahl | |
| 4,951,380 | A * | 8/1990 | Smith | 29/600 |
| 6,049,249 | A | 4/2000 | Tammaru | |

FOREIGN PATENT DOCUMENTS

DE 18 15 800 A1 6/1970

OTHER PUBLICATIONS

Jacquez and Wilson, Development of a 39.5 GHz Karp Traveling-Wave Tube for Use in Space, Oct. 1988, NASA, Cleveland OH.
Wallett and Qureshi, Theoretical, Experimental and Computational Evaluation of a Tunnel Ladder Slow-Wave Structure, Jun. 1994, NASA, Cleveland OH.
Supplementary European Search Report, Application No. EP 09 75 9450, Dated Jul. 12, 2011.
International Search Report for PCT/US09/46305.

* cited by examiner

*Primary Examiner* — Tuyet Thi Vo

(57) ABSTRACT

Various embodiments of a coupled cavity traveling wave tube are disclosed herein. For example, some embodiments provide a coupled cavity traveling wave tube including a plurality of core segments arranged in spaced-apart fashion to form an electron beam tunnel, a first longitudinal member adjacent the plurality of core segments alternately extending toward and receding from successive core segments, and a second longitudinal member adjacent to the plurality of core segments alternately extending toward and receding from successive core segments. The first and second longitudinal members are offset to extend toward different core segments.

20 Claims, 8 Drawing Sheets

COUPLED CAVITY TRAVELING WAVE TUBE

CROSS REFERENCE TO RELATED APPLICATIONS

The present application claims priority to PCT Patent Application No. PCT/US09/46305 entitled "Coupled Cavity Traveling Wave Tube", filed on Jun. 4, 2009, and to U.S. Provisional Patent Application No. 61/059,182 entitled "Design of Ladder-based Coupled Cavity TWT System", filed on Jun. 5, 2008. The aforementioned applications are assigned to an entity common hereto, and the entirety of the aforementioned applications are incorporated herein by reference for all purposes.

BACKGROUND

A traveling wave tube (TWT) is an amplifier that increases the gain, power or some other characteristic of a microwave or radio frequency (RF) signal, that is, electromagnetic waves typically within a range of around 0.3 GHz to above 300 GHZ. An RF signal to be amplified is passed through the device, where it interacts with and is amplified by an electron beam. The TWT is a vacuum device through which the electron beam travels, typically focused by a magnetic containment field to prevent the electron beam from directly touching the structure of the TWT.

The electron beam may be generated at the cathode of an electron gun, which is heated to typically about 1000 degrees Celsius. Electrons are emitted from the heated cathode by thermionic emission and are drawn through the TWT to a collector by a high voltage bias, focused by the magnetic field.

The TWT also contains a slow wave structure (SWS) such as a wire helix through which the RF signal passes. For example, in the case of the wire helix TWT, the electron beam passes through the central axis of the helix without significantly contacting or touching the inner walls of the helix. The slow wave structure is designed so that the RF signal travels the length of the TWT at about the same speed as the electron beam. As the RF signal passes through the slow wave structure, it creates an electromagnetic field that interacts with the electron beam, bunching or velocity-modulating the electrons in the beam. The velocity-modulated electron beam creates an electromagnetic field that transfers energy from the beam to the RF signal in the slow wave structure, inducing more current in the slow wave structure. The RF signal may be coupled to the slow wave structure and the amplified RF signal may be decoupled from the slow wave structure in a variety of ways, such as with directional waveguides that do not physically connect to the slow wave structure.

A number of different slow wave structures are known for use in traveling wave tubes, such as the wire helix TWT mentioned above, with corresponding advantages and disadvantages. For example, a wire helix TWT has a wide bandwidth, meaning that the RF signals that can be amplified in the wire helix TWT are less bandwidth-limited and may have a wider range of frequencies than in some other TWT designs. However, a wire helix TWT has some limitations when compared with other TWT designs. Another type of TWT is a coupled cavity TWT, in which the slow wave structure has a series of cavities coupled together. As the RF signal passes through the resonant cavities, inducing RF voltages in each cavity. When the velocity modulation of the electron beam passing adjacent the cavities is in phase, the RF voltages in each subsequent cavity increase in an additive fashion, amplifying the RF signal as it passes through the coupled cavity TWT. However, coupled cavity TWTs are often difficult to manufacture and assemble, including a large number of tiny components that must be precisely aligned and spaced. Although coupled cavity TWTs have relatively high gain, they also generally have narrower bandwidths than some other designs such as a wire helix TWT, leaving room for improvement in areas such as bandwidth and ease of construction.

SUMMARY

Various embodiments of a coupled cavity traveling wave tube are disclosed herein. For example, some embodiments provide a coupled cavity traveling wave tube including core segments arranged in spaced-apart fashion to form an electron beam tunnel, a first longitudinal member adjacent the core segments alternately extending toward and receding from successive core segments, and a second longitudinal member adjacent to the core segments alternately extending toward and receding from successive core segments. The first and second longitudinal members are offset to extend toward different core segments.

In an embodiment of the aforementioned coupled cavity traveling wave tube, the first and second longitudinal members are on opposite sides of the core segments In an embodiment of the coupled cavity traveling wave tube, the core segments comprise rungs of a ladder.

In an embodiment of the coupled cavity traveling wave tube, the first and second longitudinal members each comprise a body and protrusions which extend from the bodies toward each corresponding core segment, wherein protrusions form a series of coupled cavities.

In an embodiment of the coupled cavity traveling wave tube, the protrusions and the corresponding core segments comprise mating surfaces, wherein the mating surfaces of the protrusions are placed in contact with the mating surfaces of the corresponding core segments.

In an embodiment of the coupled cavity traveling wave tube, the mating surfaces are substantially flat.

An embodiment of the coupled cavity traveling wave tube includes a housing. The core segments and the first and second longitudinal members are substantially contained within the housing. The first and second longitudinal members extend from inner top and bottom walls of the housing In an embodiment of the coupled cavity traveling wave tube, the core segments extend to inner side walls of the housing.

In an embodiment of the coupled cavity traveling wave tube, the core segments each comprise an inner surface defining a passage. Each of the core segments is aligned to form the electron beam tunnel.

In an embodiment of the coupled cavity traveling wave tube, the passages defined by the core segments have a circular cross-section.

In an embodiment of the coupled cavity traveling wave tube, the passages defined by the core segments have a hexagonal cross-section.

An embodiment of the coupled cavity traveling wave tube includes a coating on the core segments.

An embodiment of the coupled cavity traveling wave tube includes a radio frequency input waveguide at a first end of the coupled cavity traveling wave tube and a radio frequency output waveguide at a second end of the coupled cavity traveling wave tube.

Other embodiments provide methods of manufacturing a coupled cavity traveling wave tube. In one embodiment, the method includes forming slots in a ladder to form rungs, forming a tunnel longitudinally through the ladder, and forming a first ridge having a group of protrusions forming a second ridge having a second group of protrusions. The method also includes aligning the first ridge adjacent a first side of the ladder so that the group of protrusions contacts an alternating sequence of the rungs. The method also includes aligning the second ridge adjacent a second side of the ladder so that the second ridge is offset from the first ridge, and the second group of protrusions contacts a second alternating sequence of the rungs In an embodiment of the method, the first ridge is formed in a first portion of a housing and the second ridge is formed in a second portion of the housing. The alignment of the first and second ridges includes enclosing the ladder within the first and second portions of the housing.

An embodiment of the method also includes brazing the groups of protrusions to the rungs.

In an embodiment of the method, the slots are formed using photolithography.

An embodiment of the method also includes providing a coating on the ladder.

In an embodiment of the method, the thickness of the coating is graded.

Another embodiment of a coupled cavity traveling wave tube includes a ladder having a group of rungs. Each rung includes a core segment having an inner surface defining a passage with a circular cross-section. The core segments are arranged in a spaced-apart linear array, with the passages aligned to form an electron beam tunnel. A first ridge having a group of protrusions is positioned adjacent a first side of the ladder, so that the group of protrusions contacts an alternating sequence of the core segments. A second ridge having a second group of protrusions is positioned adjacent a second side of the ladder, so that the second ridge is offset from the first ridge, and the second group of protrusions contacts a second alternating sequence of the rungs.

This summary provides only a general outline of some particular embodiments. Many other objects, features, advantages and other embodiments will become more fully apparent from the following detailed description, the appended claims and the accompanying drawings.

BRIEF DESCRIPTION OF THE DRAWINGS

A further understanding of the various embodiments may be realized by reference to the figures which are described in remaining portions of the specification. In the figures, like reference numerals may be used throughout several drawings to refer to similar components.

DESCRIPTION

Figure 1:
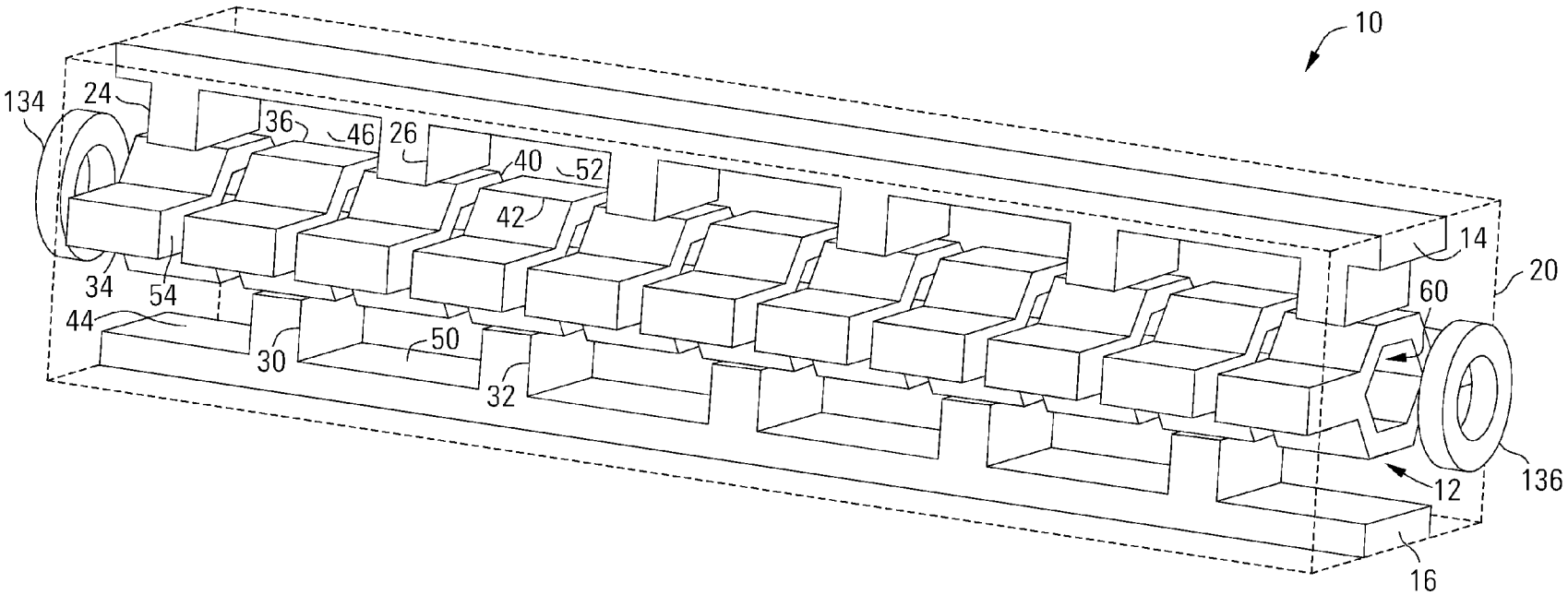
FIG. 1 depicts a perspective inside view of a coupled cavity traveling wave tube with a tunnel having a hexagonal cross-section in accordance with some embodiments of the invention.

The drawings and description, in general, disclose a coupled cavity traveling wave tube (TWT). Various embodiments of the coupled cavity TWT provide benefits such as higher bandwidth and/or gain than other coupled cavity TWTs, as well as simple and precise manufacturing and assembly techniques. As illustrated in FIGS. 1-5, the coupled cavity TWT 10 has a central structure 12 with ridges 14 and 16 adjacent to the central structure 12, all within a cavity or chamber 20 in a housing. The ridges 14 and 16 (also referred to herein as longitudinal members) are oriented along a longitudinal or Z axis 22 adjacent the central structure 12. The central structure 12 and ridges 14 and 16 form a slow wave structure through which an RF signal passes.

The ridges 14 and 16 each have a number of protrusions (e.g., 24, 26, 30 and 32) extending toward alternating core segments (e.g., 34, 36, 40 and 42) in the central structure 12. For example, the first ridge 14 extends toward the first core segment 34 with its first protrusion 24, recedes from the second core segment 36, and extends toward the third core segment 40 with its second protrusion 26. The second ridge 16 is offset from the first ridge 14, receding from the first core segment 34, extending toward the second core segment 36 with its first protrusion 30, receding from the third core segment 40, and extending toward the fourth core segment 42 with its second protrusion 32. The offset protrusions (e.g., 24, 26, 30 and 32) on the ridges 14 and 16 thus form a series of coupled cavities (e.g., 44, 46, 50 and 52). The cavities (e.g., 44, 46, 50 and 52) are coupled via the spaces or gaps (e.g., 54) between each successive core segment (e.g., 34 and 36), as well as via other open portions of the chamber 20, if any, such as alongside the ridges 14 and 16. In some embodiments, the protrusions (e.g., 24, 26, 30 and 32) may be referred to as supports, at least in part based on providing support to the core segments (e.g., 34, 36, 40 and 42) in the central structure 12 in these embodiments.

The ridges thus comprise protrusions (e.g., 24, 26, 30 and 32) or supports and, in some embodiments, a longitudinal backbone portion or body (e.g., 56) running parallel with the Z axis 22. The ridge backbones (e.g., 56) may have any suitable height 58. The ridge backbones (e.g., 56), if included, enhance the mechanical, structural and thermal properties of the design. However, the height 58 of the ridge backbones (e.g., 56) may be adjusted to tune the bandwidth of the TWT 10, including to a zero thickness.

Figure 6:
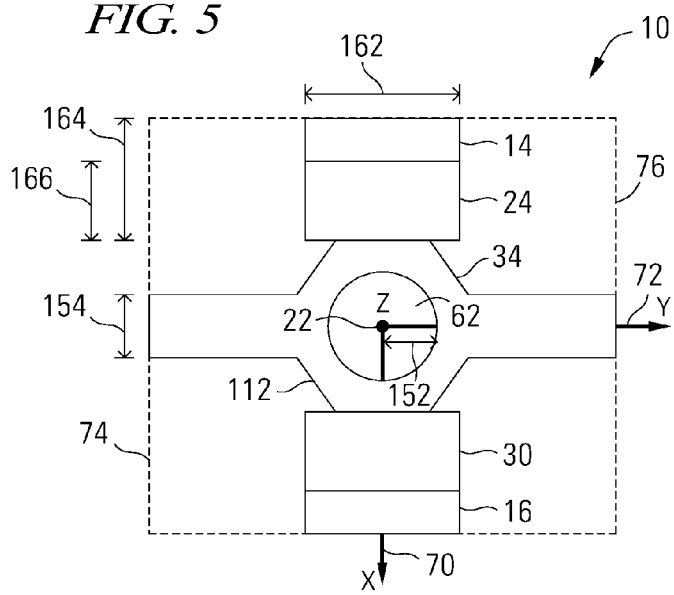
FIG. 6 depicts an end view of a coupled cavity traveling wave tube having a circular cross-section in accordance with some embodiments of the invention.

The chamber 20 is formed in a housing to be described below, with any suitable cross-section shape to the inner and outer walls. For example, as illustrated in FIG. 3, the chamber 20 may have an inner wall having a cross-section that is substantially square or rectangular. In other embodiments, the chamber 20 may have a rectangular cross-section with rounded corners, or a round, elliptical or oval cross-section, or any other suitable shape to provide the desired performance characteristics and to provide ease of manufacturing. A substantially square or rectangular cross-section in the chamber 20 is particularly simple to produce using a number of fabrication techniques ranging from conventional machining techniques such as using a rotating cutting bit to mill the chamber 20 with its ridges (e.g., 14 and 16) and protrusions (e.g., 24 and 26) from a solid block of material to microfabrication techniques and various hybrid manufacturing techniques. In other embodiments, the ridges (e.g., 14 and 16) may be independent elements that are separately formed and mounted within the housing. An electron beam tunnel 60 is formed along the Z axis 22 through the core segments (e.g., 34, 36, 40 and 42 in the central structure 12. The shape of the cross-section of the tunnel 60 may be adapted to give the desired operating characteristics and based on manufacturing constraints. For example, the inner wall of the beam tunnel may have a cross-section with a circular, square, rectangular, hexagonal, oval, elliptical or any other desired shape based on factors such as ease of manufacturing and coupling requirements between the electron beam and the slow wave structure. The hexagonal tunnel 60 illustrated in FIGS. 1-3 can be manufactured by bending and joining two ladder halves without drilling as will be described in more detail below. The circular tunnel 62 illustrated in FIG. 6 can be manufactured by drilled along the Z axis 22 which may require more precision in the machining process but which generally provides greater coupling between an electron beam passing through the tunnel 62 and the RF signal traveling through the central structure 12 and ridges 14 and 16 making up the slow wave structure.

In one embodiment, the ridges 14 and 16 are positioned on opposite sides of the central structure 12, extending from inner top and bottom walls 64 and 66, respectively, along an X axis 70. (See FIG. 3) In this embodiment, the protrusions (e.g., 24 and 26) extend from the ridges 14 and 16 along the X axis 70. The width of the ridges 14 and 16 and protrusions (e.g., 24 and 26) along a Y axis 72 can be varied as desired.

For example, the 14 and 16 and protrusions (e.g., 24 and 26) may be about as wide as the core segments (e.g., 34) as illustrated in the drawings, or may fully extend between the inner side walls 74 and 76 to fill the chamber 20 from side to side if desired, although the operating characteristics of the TWT 10 will vary with these changes. It is important to note that the terms top, bottom and side are used herein merely to distinguish various surfaces inside the TWT 10 and do not imply any particular rotational orientation about the Z axis 22. It is also important to note that the variations of the above embodiments are meant as examples of the present invention and are in no way limiting of all of the potential embodiments of the present invention especially in terms of size, shape, overlap, extending of, number and placement of, etc. the protrusions, ridges, and other geometrical shapes, positions, types, etc.

Figure 2:
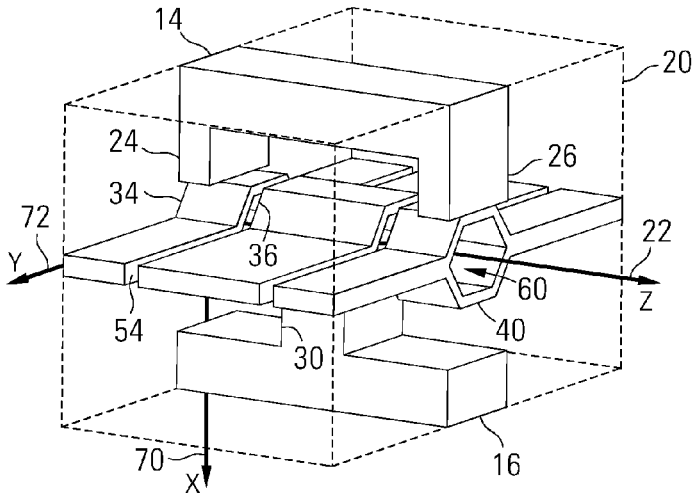
FIG. 2 depicts a perspective inside view of a unit cell of the coupled cavity traveling wave tube of FIG. 1.
Figure 3:
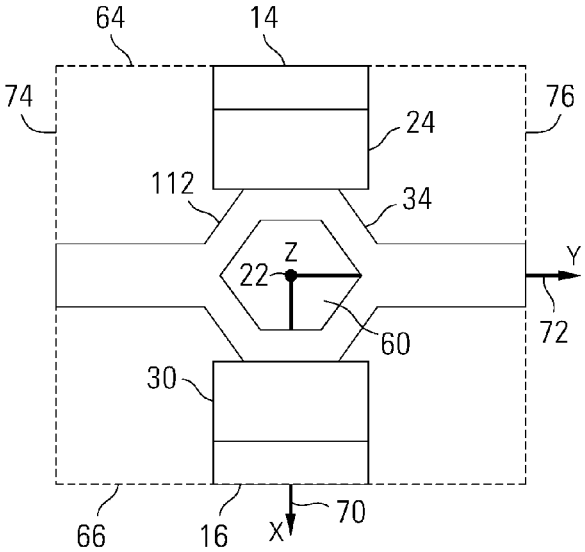
FIG. 3 depicts an end view of the unit cell of FIG. 2.
Figure 4:
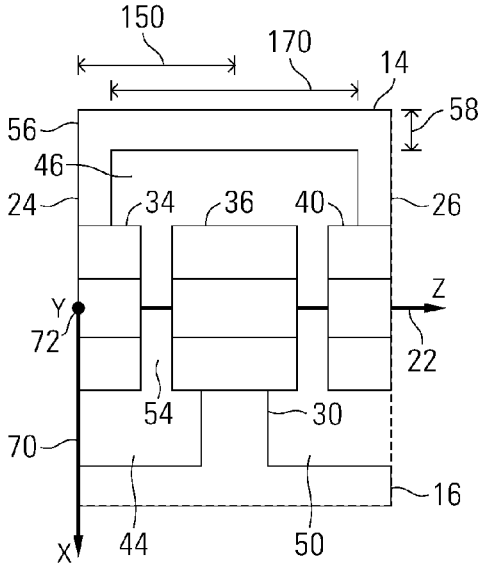
FIG. 4 depicts a side view of the unit cell of FIG. 2.
Figure 5:
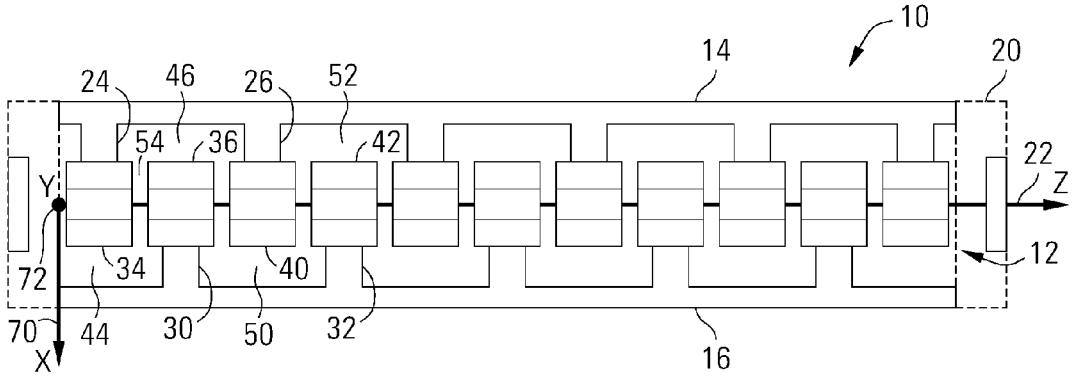
FIG. 5 depicts a side view of the inside of a coupled cavity traveling wave tube in accordance with some embodiments of the invention.

A single unit cell is illustrated in shown in FIGS. 2-4, which may be repeated as desired along the Z axis 22 to provide a particular amplification or gain to an RF signal.

Figure 7:
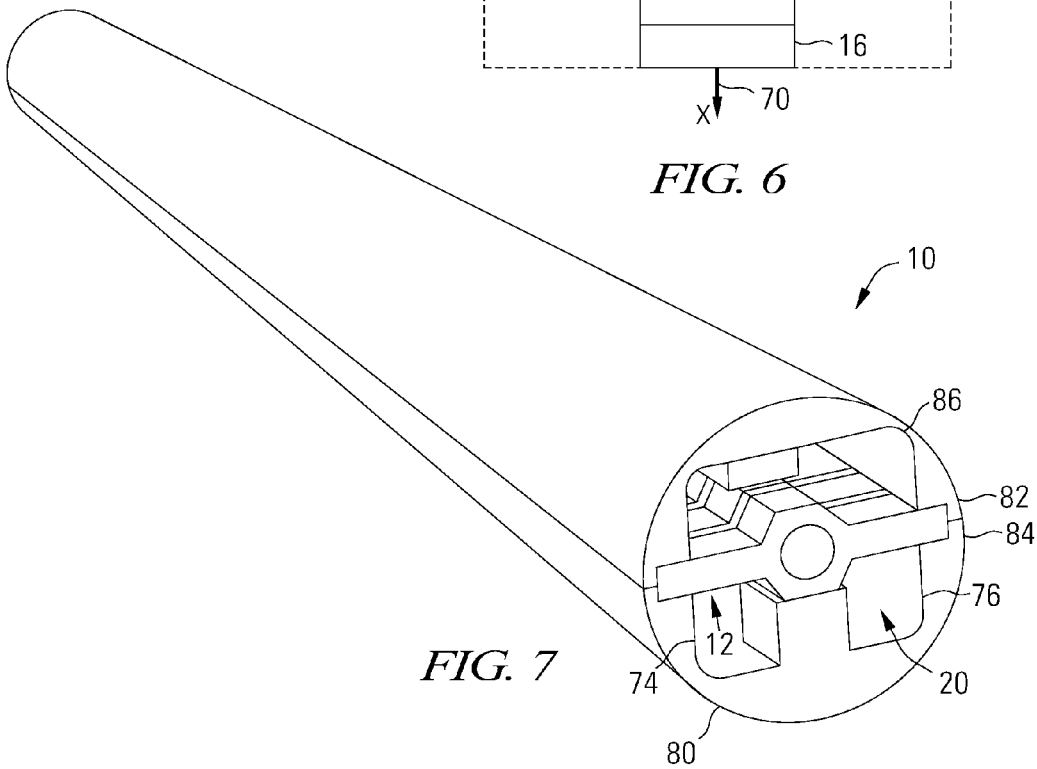
FIG. 7 depicts a perspective view a coupled cavity traveling wave tube with a cylindrical housing in accordance with some embodiments of the invention.

Referring now to FIG. 7, an example of a cylindrical housing 80 is shown, being formed in two halves 82 and 84 with the central structure 12 sandwiched inside the housing 80 between the two halves 82 and 84. As with previous embodiments, the inner cross-section of the chamber 20 is substantially rectangular, with rounded corners (e.g., 86) which may minimize edge effects in the RF signal, although numerous other shapes and styles can be used for the present invention. The housing 80 may serve as a vacuum envelope in some embodiments, or a vacuum may be alternatively provided for as desired and as needed.

Figure 8:
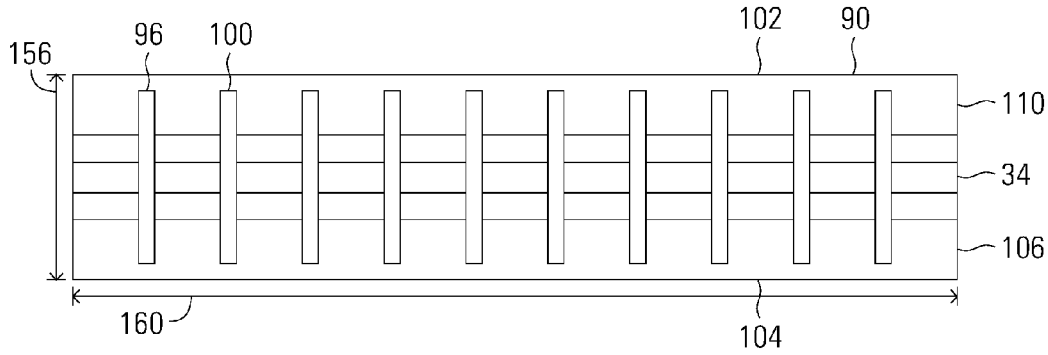
FIG. 8 depicts a top view of a ladder for use in a coupled cavity traveling wave tube in accordance with some embodiments of the invention.
Figure 9:
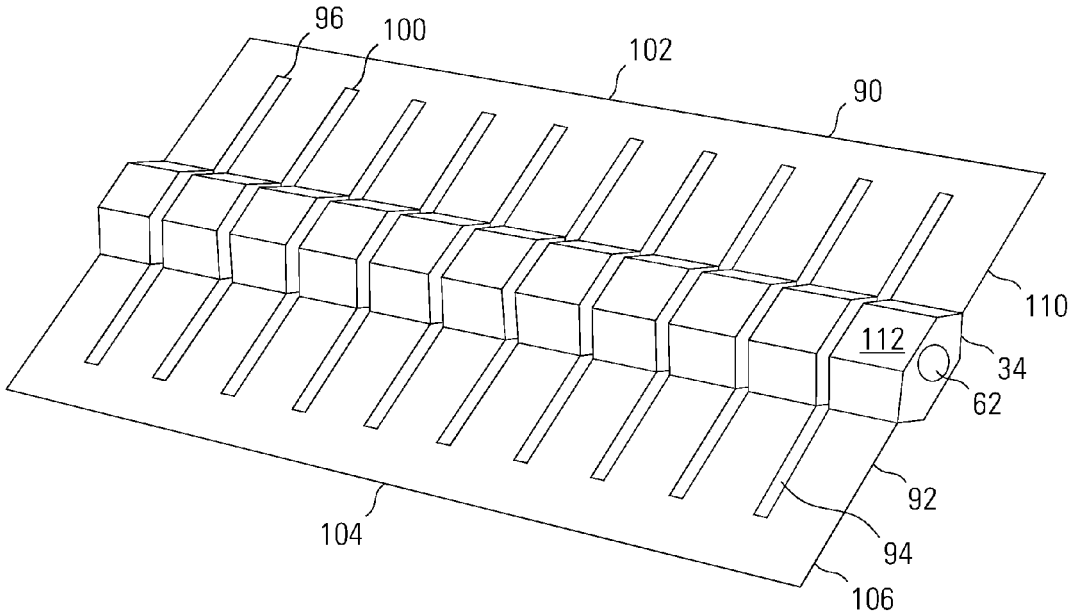
FIG. 9 depicts a perspective view of a ladder for use in a coupled cavity traveling wave tube in accordance with some embodiments of the invention.

The coupled cavity TWT 10 is not limited to any particular central structure 12. In one embodiment illustrated in FIGS. 8 and 9, the central structure 12 comprises a ladder 90 having a number of rungs (e.g., 92 and 94). The ladder 90 can be manufactured in as few as one or two pieces using techniques such as lithography and machining, and can be assembled quickly and easily with high precision. A series of slots (e.g., 96 and 100) may be cut or otherwise formed in the ladder 90 to separate and define each segment of the central structure 12. The width of the slots (e.g., 96 and 100) may be adapted as desired to provide the required operating characteristics. Parameters and properties such as the length, spacing, thickness, periodicity, etc. can be varied along the length dimension of the structure in linear, power-law, exponential, and any other way imaginable, realizable, etc. to provide desired performance behavior (i.e., gain, linearity, efficiency, power, etc.) and enhancements. A circular tunnel 62 may be formed, for example, by drilling longitudinally through the ladder 90 using any technique, including but not limited to conventional drilling, end milling, EDM, laser milling, laser ablation, micromachining, etching, plasma processing, etc. In another embodiment, the ladder 90 may be formed of two halves which are mated and connected to form the tunnel, or as a single piece with two halves formed side by that is folded over. For example, a hexagonal tunnel 60 may be formed by bending each half to form a three-sided half-hexagonal core segment and mating the two halves to form a hexagonal tunnel 60. A circular tunnel 62 may be formed by milling, micromaching, or otherwise creating a semicircular trough along the Z axis 22 of each half and mating the two halves to form the circular tunnel 62. The two halves may be aligned using traditional techniques such as registration marks or pins, or by self-alignment techniques, microfabrication, micromaching, MEMS, etc. and mated or connected by brazing, bonding, electrically conductive adhesives, or any other suitable technique.

By ending the slots (e.g., 96 and 100) in the ladder 90 short of the edges 102 and 104, the ladder 90 remains in a single integral piece that maintains the desired gap between each segment. The slots (e.g., 96 and 100) may be formed to fully extend between the side walls 74 and 76 as illustrated in FIG. 7, or may stop short of the side walls 74 and 76 if desired although the coupling between cavities (e.g., 44 and 46) will be reduced. The segments of the ladder 90 comprise core segments (e.g., 34) through which the tunnel 62 passes with wings 106 and 110 extending from the core segments (e.g., 34). The wings 106 and 110 may be thinner along the X axis 70 as illustrated in the drawings or may be as thick as or thicker than the core segments (e.g., 34) if desired. The wings 106 and 110 extend at least to the side walls 74 and 76 for ease in manufacturing and to provide support to the core segments (e.g., 34) beyond that provided by the ridge protrusions (e.g., 44 and 46), as well as to provide a thermal connection between the housing 80 and the ladder 90 to dissipate heat.

The core segments (e.g., 34) of the ladder 90 have mating surfaces (e.g., 112) that are substantially matched to corresponding mating surfaces on the ridge protrusions (e.g., 24) to form a connection between the core segments (e.g., 34) and the protrusions (e.g., 24). These mating surfaces (e.g., 112) provide an electrical, mechanical and thermal connection between the ladder 90 and the ridges 14 and 16 to conduct electricity, provide support to and conduct heat from the ladder 90, and substantially separate adjacent but non-coupled cavities. The ladder 90 and the ridges 14 and 16 may merely be held in contact physically or may be brazed, connected by adhesives or attached in any other suitable manner. Although the ladder 90 and the ridges 14 and 16 are shorted together from a DC standpoint, the slow wave structure including the ladder 90 and the ridges 14 and 16 are adapted to provide the desired impedance from an AC standpoint at the RF operating frequencies of the TWT 10.

The core segments (e.g., 34) of one embodiment have a cross-section with an outer hexagonal shape 112, although the TWT central structure 12 is not limited to this configuration. Other embodiments may have any shape suitable to achieve the desired operating characteristics and ease of manufacturing, such as a square, circular, elliptical or oval, rectangular or any other desired cross-section.

A ladder-based central structure 12 has been described above as one particular embodiment. However, the central structure 12 is not limited to this configuration. The central structure 12 may comprise other structures that combine with the offset ridges 14 and 16 to form coupled cavities. For example the central structure 12 may comprise a helix, double helix, ring bar structure, etc.

Figure 10:
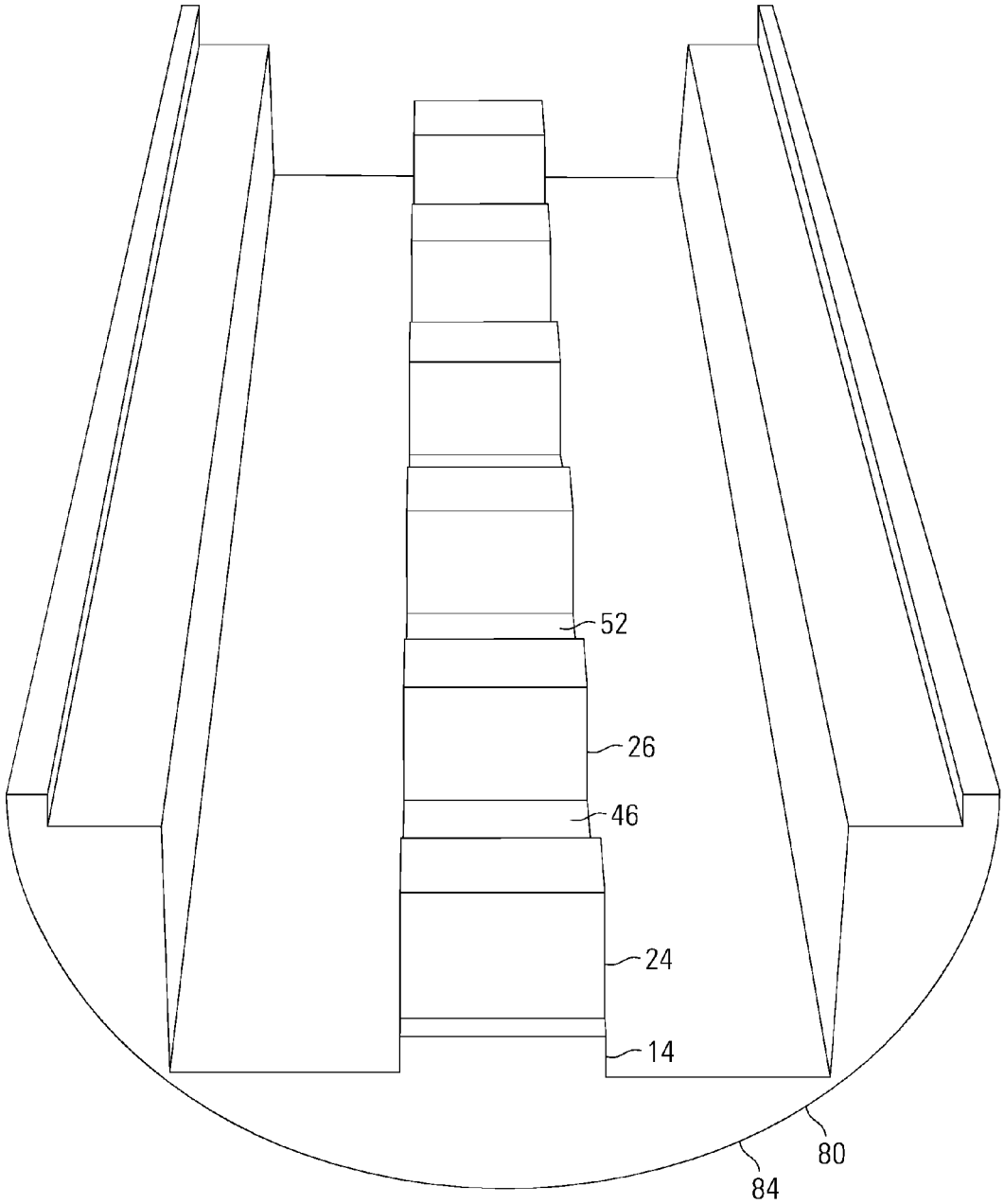
FIG. 10 depicts a perspective view of one half of a cylindrical housing of a coupled cavity traveling wave tube with a ridge having a plurality of protrusions in accordance with some embodiments of the invention.
Figure 11:
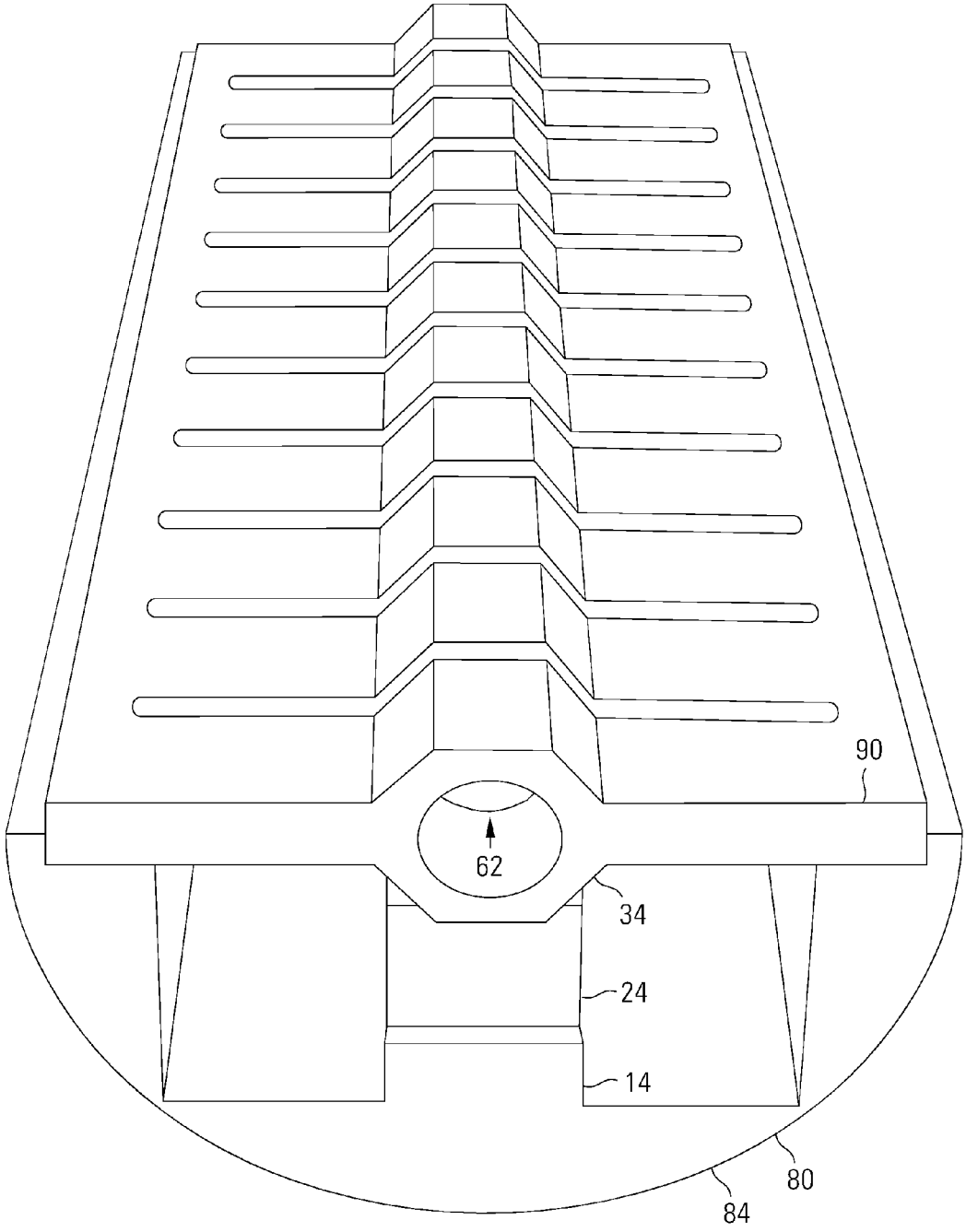
FIG. 11 depicts a perspective view of a tunnel ladder positioned in one half of a cylindrical housing of a coupled cavity traveling wave tube in accordance with some embodiments of the invention.

Referring now to FIG. 10, an example of a cylindrical housing 80 formed in two halves (e.g., 84) is illustrated. A cylindrical housing 80 is convenient for mounting external electron beam containment magnets to form a pencil beam through the tunnel 62, although the housing 80 is not limited to this configuration. As discussed above, the ridges (e.g., 14) and protrusions (e.g., 24) may be machined, micromachined, milled or otherwise formed directly in the body of the housing 80, or may be separately formed and attached to inner surfaces in the housing 80. Note that the housing 80 is not limited to two halves, but may be formed in other manners. As illustrated in FIG. 11, the ladder 90 may be enclosed in the TWT 10 between the portions 82 and 84 of the housing 80 so that the protrusions (e.g., 24) are aligned with the core segments (e.g., 34). The housing 80 may be assembled in any suitable manner, such as with mechanical connection elements, brazing, bonding, adhesives, etc.

Figure 12:
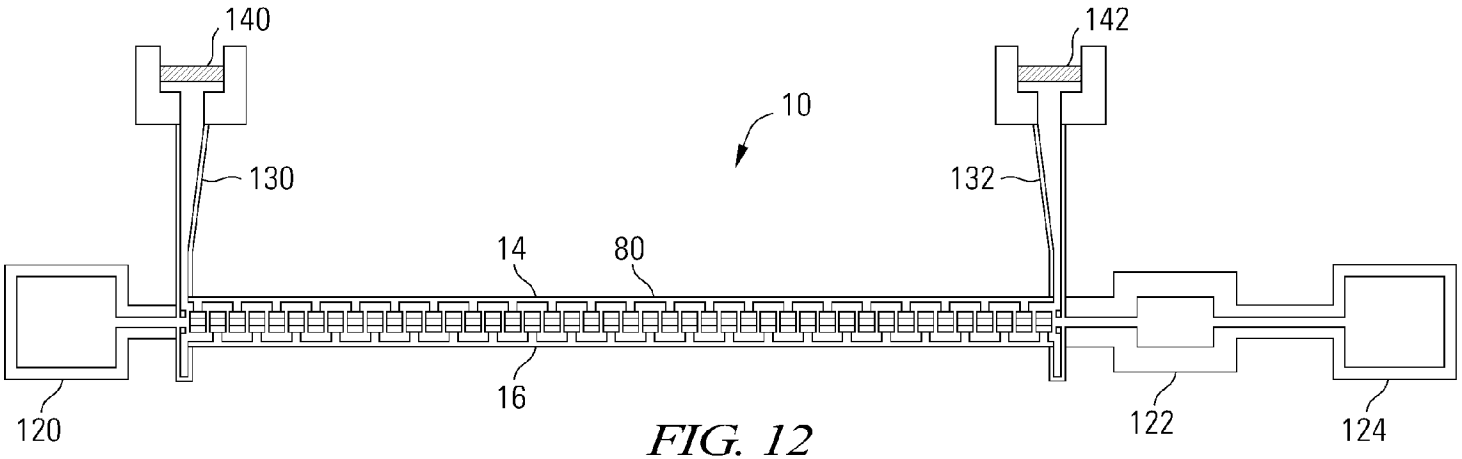
FIG. 12 depicts a cross-sectional side view of a coupled cavity traveling wave tube with input and output RF waveguides in accordance with some embodiments of the invention.
Figure 13:
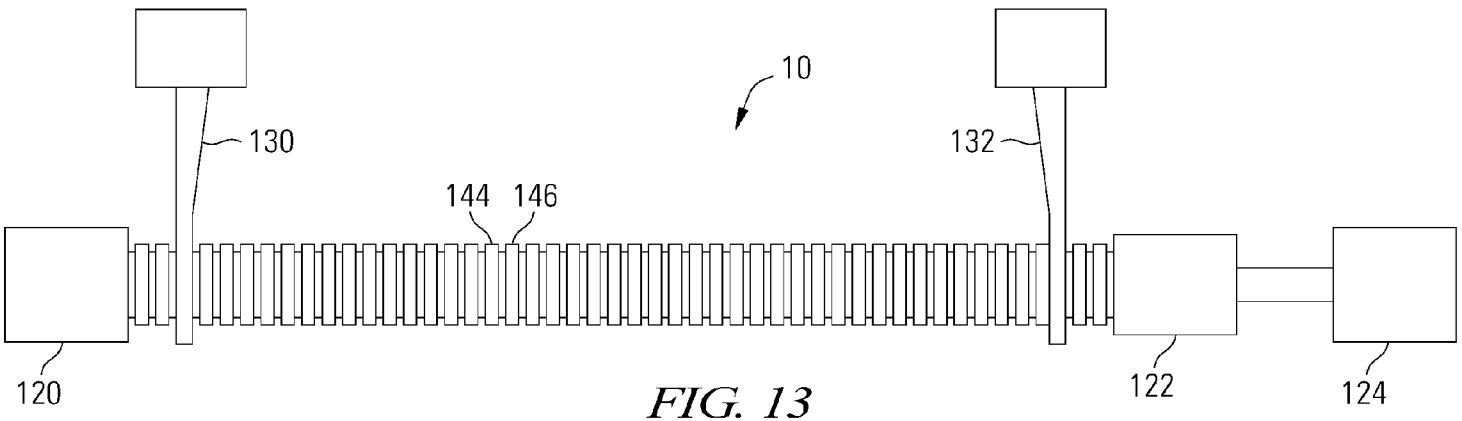
FIG. 13 depicts a side view of a coupled cavity traveling wave tube with electron beam steering magnets in accordance with some embodiments of the invention.

A cross-sectional view of the coupled cavity TWT 10 is illustrated in FIG. 12. An electron gun 120 is connected to one end of the TWT 10 and a collector 122 is connected to the other end. An ion pump 124 or other vacuum forming device is also connected to the TWT 10 to evacuate the TWT 10. (Details of the electron gun 120, collector 122 and ion pump 124 are not shown in the cross-sectional view of FIG. 12, as the TWT 10 is not limited to use with any particular type of electron beam and vacuum equipment.) An RF input 130 and output 132 are connected at couplers 134 and 136 at the ends of the TWT 10. For example, hollow waveguides having with RF-transparent windows 140 and 142 to maintain a vacuum in the TWT 10 may be used. As shown in FIG. 13, devices to form a magnetic field, such as periodic permanent magnets (e.g., 144 and 146) are placed around or adjacent the TWT 10 to steer the electron beam through the tunnel 62 between the electron gun 120 and collector 122. Note that the TWT 10 of FIGS. 12 and 13 has a different number of core segments 34 than other drawings. As discussed above, the TWT 10 may be extended, modified, augmented, enhanced, increased, etc. based on the desired amplification.

During operation, the ion pump 124 produces a vacuum within the TWT 10, the electron gun 120 is heated and a large bias voltage is applied across the electron gun 120 and collector 122. This generates an electron beam between the cathode of the electron gun 120 and the collector 122. The electron beam is focused or contained in the tunnel through the central structure 12 by a magnetic field generated by, for example, the periodic permanent magnets (e.g., 144 and 146). An RF signal is applied at the RF input 130 and is coupled to the slow wave structure including the central structure 12 (e.g., the ladder 90) and the ridges 14 and 16 connected in alternating, offset fashion to the central structure 12 by the protrusions (e.g., 24). The TWT 10 is adapted to cause the RF signal to travel along the length of the TWT 10 at about the same speed as the electron beam, maximizing the coupling between the electron beam and the RF signal. Energy from the electron beam is coupled to the RF signal, amplifying the RF signal, and the amplified RF signal is decoupled from the slow wave structure to the RF output 132 before the electron beam reaches the collector 122.

Dimensions of one non-limiting example of a Ku band coupled cavity TWT 10 are provided in Table 1 below. Dimensions will vary based on the RF frequency, desired bandwidth, and design variations as discussed above. Dimensions are identified in FIGS. 4, 6 and 8.

TABLE 1

| Name | Element Number | Dimension, mm |
|---|---|---|
| Pitch | 150 | 4.12 |
| Beam tunnel radius | 152 | 0.81 |
| Ladder thickness | 154 | 0.46 |
| Ladder width | 156 | 1.62 |
| Ladder length | 160 | 7.47 |
| Ridge width | 162 | 2.26 |
| Ridge height | 164 | 2.17 |
| Ridge gap depth | 166 | 1.49 |
| Ridge gap length | 170 | 3.10 |

The coupled cavity TWT 10, including the housing 80, ladder 90 and ridges 14 and 16, may comprise any electrically conductive material selected based on the required operating characteristics, such as copper, a copper alloy, molybdenum, tantalum, tungsten, etc, providing a suitably high melting point and conductivity. One or more severs may be provided at various locations along the TWT 10 to control the gain by absorbing energy in order. This prevents reflections from the output end of the TWT 10 to the input end which would cause oscillations in the TWT 10. In addition to or in place of the severs, a coating or film may be applied to the ladder 90 and/or the ridges 14 and 16 to control the gain, using any suitable material having the desired conductivity and patterned in any way or form including, but not limited to, two and three dimensional patterns and tapers. Any method of coating (i.e., thin film, thick film, sputtering, physical vapor deposition, chemical vapor deposition, pyrolysis, thermal cracking, thermal evaporation, plasma and plasma enhanced deposition techniques, plating, electro-deposition, electrolytic, etc. may be used to achieve the desired results. Because the ladder 90 may be formed as an integral unit, the thickness and placement of a coating may be controlled relatively easily and applied by a number of suitable techniques such as sputtering, vapor deposition, etc. as discussed above. The thickness or conductivity of the coating may be varied along the length of the TWT 10 if desired to control the conductivity as needed.

Figure 14:
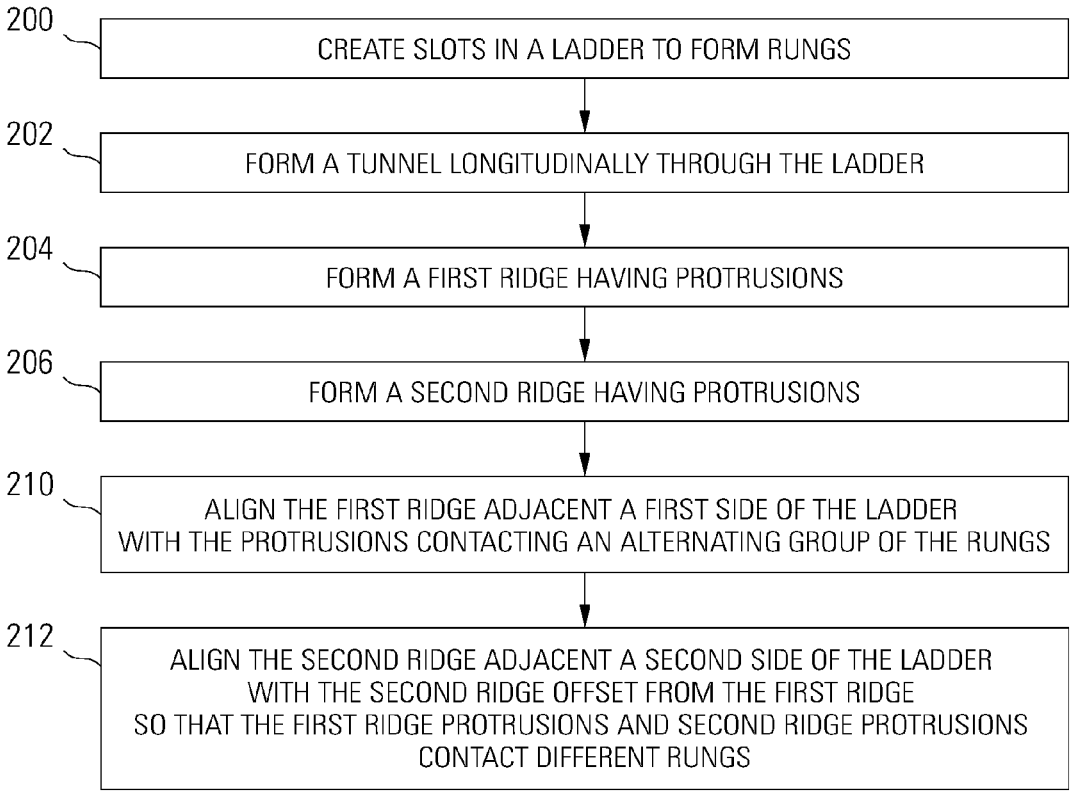
FIG. 14 is a flow chart of an operation for manufacturing a coupled cavity traveling wave tube in accordance with some embodiments of the invention.

Referring now to FIG. 14, a method for manufacturing a coupled cavity traveling wave tube includes creating slots in a ladder to form rungs (block 200) and forming a tunnel longitudinally through the ladder. (Block 202) The method also includes forming a first ridge having protrusions (block 204) and forming a second ridge having protrusions. (Block 206) The first ridge is aligned or positioned adjacent a first side of the ladder with the protrusions contacting an alternating group of the rungs. (Block 210) The second ridge is aligned adjacent a second side of the ladder with the second ridge offset from the first ridge so that the first ridge protrusions and second ridge protrusions contact different rungs. (Block 212)

While illustrative embodiments have been described in detail herein, it is to be understood that the concepts disclosed herein may be otherwise variously embodied and employed.

What is claimed is:

1. A coupled cavity traveling wave tube comprising:

a plurality of core segments arranged in spaced-apart fashion to form an electron beam tunnel;

a first longitudinal member adjacent the plurality of core segments alternately extending toward and receding from successive core segments;

a second longitudinal member adjacent to the plurality of core segments alternately extending toward and receding from successive core segments, wherein the first and second longitudinal members are offset to extend toward different core segments.

2. The coupled cavity traveling wave tube of claim 1, wherein the first and second longitudinal members are on opposite sides of the plurality of core segments.

3. The coupled cavity traveling wave tube of claim 1, wherein the plurality of core segments comprise rungs of a ladder.

4. The coupled cavity traveling wave tube of claim 1, wherein the first and second longitudinal members each comprise a body and a plurality of protrusions which extend from the bodies toward each corresponding core segment, wherein the pluralities of protrusions form a series of coupled cavities.

5. The coupled cavity traveling wave tube of claim 4, wherein the pluralities of protrusions and the corresponding core segments comprise mating surfaces, wherein the mating surfaces of the pluralities of protrusions are placed in contact with the mating surfaces of the corresponding core segments.

6. The coupled cavity traveling wave tube of claim 5, wherein the mating surfaces are substantially flat.

7. The coupled cavity traveling wave tube of claim 1, further comprising a housing, the plurality of core segments and the first and second longitudinal members being substantially contained within the housing, wherein the first and second longitudinal members extend from inner top and bottom walls of the housing.

8. The coupled cavity traveling wave tube of claim 7, wherein the plurality of core segments extend to inner side walls of the housing.

9. The coupled cavity traveling wave tube of claim 1, wherein the plurality of core segments each comprise an inner surface defining a passage, wherein each of the plurality of core segments is aligned to form the electron beam tunnel.

10. The coupled cavity traveling wave tube of claim 9, wherein the passages defined by the plurality of core segments have a circular cross-section.

11. The coupled cavity traveling wave tube of claim 9, wherein the passages defined by the plurality of core segments have a hexagonal cross-section.

12. The coupled cavity traveling wave tube of claim 1, further comprising a coating on the plurality of core segments.

13. The coupled cavity traveling wave tube of claim 7, further comprising a radio frequency input waveguide at a first end of the coupled cavity traveling wave tube and a radio frequency output waveguide at a second end of the coupled cavity traveling wave tube.

14. A method of manufacturing a coupled cavity traveling wave tube, the method comprising:

forming slots in a ladder to form a plurality of rungs;

forming a tunnel longitudinally through the ladder;

forming a first ridge having a plurality of protrusions;

forming a second ridge having a second plurality of protrusions;

aligning the first ridge adjacent a first side of the ladder, wherein the plurality of protrusions contact an alternating sequence of the plurality of rungs; and aligning the second ridge adjacent a second side of the ladder, wherein the second ridge is offset from the first ridge, wherein the second plurality of protrusions contact a second alternating sequence of the plurality of rungs.

15. The method of claim 14, wherein the first ridge is formed in a first portion of a housing and wherein the second ridge is formed in a second portion of the housing, wherein said aligning the first ridge and said aligning the second ridge comprises enclosing the ladder within the first and second portions of the housing.

16. The method of claim 15, further comprising brazing the plurality of protrusions and the second plurality of protrusions to the plurality of rungs.

17. The method of claim 14, wherein said forming slots in the ladder comprise forming said slots using photolithography.

18. The method of claim 14, further comprising providing a coating on the ladder.

19. The method of claim 18, further comprising grading a thickness of the coating.

20. A coupled cavity traveling wave tube comprising:

a ladder having a plurality of rungs, each comprising a core segment having an inner surface defining a passage with a circular cross-section, the plurality of core segments arranged in a spaced-apart linear array, wherein the passages are aligned to form an electron beam tunnel;

a first ridge having a plurality of protrusions positioned adjacent a first side of the ladder, wherein the plurality of protrusions contact an alternating sequence of the plurality of core segments; and a second ridge having a second plurality of protrusions positioned adjacent a second side of the ladder, wherein the second ridge is offset from the first ridge, and wherein the second plurality of protrusions contact a second alternating sequence of the plurality of rungs.

* * * * *